US005211320A

United States Patent [19]

Hubele

[11] Patent Number: 5,211,320

[45] Date of Patent: May 18, 1993

[54] DEVICE FOR BENDING OVER FABRICS TO BE SEWN

[75] Inventor: Heinz Hubele, Kaiserslautern, Fed. Rep. of Germany

[73] Assignee: G. M. Pfaff Aktiengesellschaft, Kaisers Lautern, Fed. Rep. of Germany

[21] Appl. No.: 868,297

[22] Filed: Apr. 14, 1992

[30] Foreign Application Priority Data

Apr. 22, 1991 [DE] Fed. Rep. of Germany ..... 4113131

[51] Int. Cl.[5] ..... A41H 33/00

[52] U.S. Cl. ..... 223/38; 112/121.15; 112/147

[58] Field of Search ..... 112/121.15, 121.12, 112/104, 147, 141, 262.3, 265.1; 223/38, 37

[56] References Cited

U.S. PATENT DOCUMENTS

| | | | |
|---|---|---|---|
| 4,347,955 | 9/1982 | Kamal | 223/38 |
| 4,445,631 | 5/1984 | Olivares | 223/38 X |
| 4,821,659 | 4/1989 | Morii et al. | 223/38 X |
| 4,982,676 | 1/1991 | Morii et al. | 223/38 X |
| 5,058,517 | 10/1991 | Morii et al. | 223/38 X |

*Primary Examiner*—Peter Nerbun
*Attorney, Agent, or Firm*—McGlew and Tuttle

[57] ABSTRACT

The present invention pertains to a device for bending over a fabric, especially pockets to be sewn onto a fabric layer, with plates that are arranged in essentially parallel planes and cooperate with one another, a fabric support plate and bending plates, and with a pressing member that can be placed over the fabric, as well as with guide surfaces for the bending area of the fabric. It accomplishes the task of designing the device such that reliable and accurate bending of the fabric is made possible in a relatively simple manner, with only minor effort for adjustment. To achieve this, it has a pressing member (4), whose outer contour extends beyond the outer contour of the fabric support plate (1) in the area of the bending edges of the fabric support plate (1), and which has, at least in its edge zone, an elastically deformable holding member (15) for the fabric (2), which forms a guide surface for the fabric (2) in its bending area after the pressing member (4) has been placed over the fabric (2).

5 Claims, 2 Drawing Sheets

DEVICE FOR BENDING OVER FABRICS TO BE SEWN

FIELD OF THE INVENTION

The present invention pertains to a device for bending over fabrics to be sewn and more particularly to a device with a fabric support and a pressing member that can be placed on the fabric, with bending plates that cooperate with the fabric support place and are movable beneath and in parallel to the plane of the fabric support plate as well as with guide means for a bending area of the fabric, the invention specifically pertaining to bending fabric, especially pockets to be sewn onto a layer of fabric to be sewn.

BACKGROUND OF THE INVENTION

DE No. 40,08,148 A1 discloses a fabric bending device or a device for bending over fabrics to be sewn, which has plates that are arranged displaceably in essentially parallel planes and cooperate—a fabric support plate or a fabric holding plate (24) and bending plates or a number of bending pieces (35)—for folding or bending over, a clamping device (51) for exerting a clamping force to bend the bending edges of the fabric, as well as a pressing member, a pressing plate (28. The pressing member can be placed on the fabric and has, in its edge zone, bent over edges which form a guide surface for the fabric in its bending area.

When the pressing member (28) is placed on the fabric—a pocket fabric P—this fabric is bent in the bending area by the bent edges of the pressing member (28), and is subsequently bent over by the bending plates (35), while the clamping device (51) becomes active by pulling the bending plates (35) during the bending process from the bottom against the underside of the fabric support plate (34) or against the bent fabric edges.

The arrangement of clamping members (51*a*, 52*a*) belonging to the clamping device (51) to achieve clean bending and to fix the bend edge of fabric at the fabric support plate (24) is relatively complicated. In addition, there is a risk that the edge of the fabric (P) will be damaged by the bending plates (35) as a consequence of the clamping process when bending over and placing against the fabric support plate (24). In addition, pre-adjustment of the pressing member (28) in relation to the fabric support plate (24) as a function of the fabric (P) to be bent is recommended.

SUMMARY AND OBJECTS OF THE INVENTION

It is an object of the present invention to provide a device for bending over fabric, especially pockets, with which reliable and accurate bending of the fabric is made possible in a relatively simple manner, with a low effort in terms of adjustment.

According to the invention, a device for bending over a fabric is provided, particularly a pocket part to be sewn onto a layer of fabric. The device comprises a fabric support plate, a pressing member that can be placed on the fabric, with bending plates that cooperate with the fabric support plate and are movable beneath and in parallel to the plane of the fabric support plate. Guide means are provided for the bending area of the fabric. In the area of the bending edges of the fabric support plate, the outer contour of the pressing member extends beyond the outer contour of the fabric support plate. The pressing means has, at least in its edge zone, an elastically deformable holding means for the fabric. The elastically deformable holding means forms the guide surface for the bending area of the fabric after the pressing means has been placed over this fabric.

The device according to the present invention advantageously permits reliable and clean bending of fabrics at a fabric support plate, while avoiding major efforts for adjustment during the coordination and adjustment of the pressing member to the fabric support plate. The accuracy of coordination of the outer contours of these two bending tools—the pressing member and the fabric support plate—is of secondary importance now, because the elasticallydeformable holding means is present in a sufficiently broad edge zone of the pressing member and is available to the outer contours of the opposite fabric support plate, which outer contours serve to bend nd fold over the fabric. The pressing member is thus able to assume its function, namely, to fix the fabric and bend it accurately at the outer contours of the fabric support plate,even in the case of a relative displacement in relation to the fabric support plate. The holding means is compressed in the area of the fabric support plate when the pressing member is pressed onto the fabric located on the fabric support plate and serves as an abutment for bending and laterally supporting the fabric in the area next to this fabric support plate, i.e., in the bending area of the fabric.

Particular advantages are gained according to the invention wherein the holding means is arranged on a side of the pressing member facing the fabric support plate along its edge zone extending on both sides of the outer contour of the fabric support plate facing it. Significant advantages are provided by the invention including the holding means in the form of a VELCRO type fastening strip (hook fastening strip).

It should also be mentioned that arched pressing members, which have rubber pads on their peripheries, are used in the manufacture of neckties to improve the support for the fabric, to achieve uniform pressure distribution on the fabric, and to muffle noises.

Still another object of the invention is to provide a device for bending over fabrics to be sewn, particularly pockets, which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
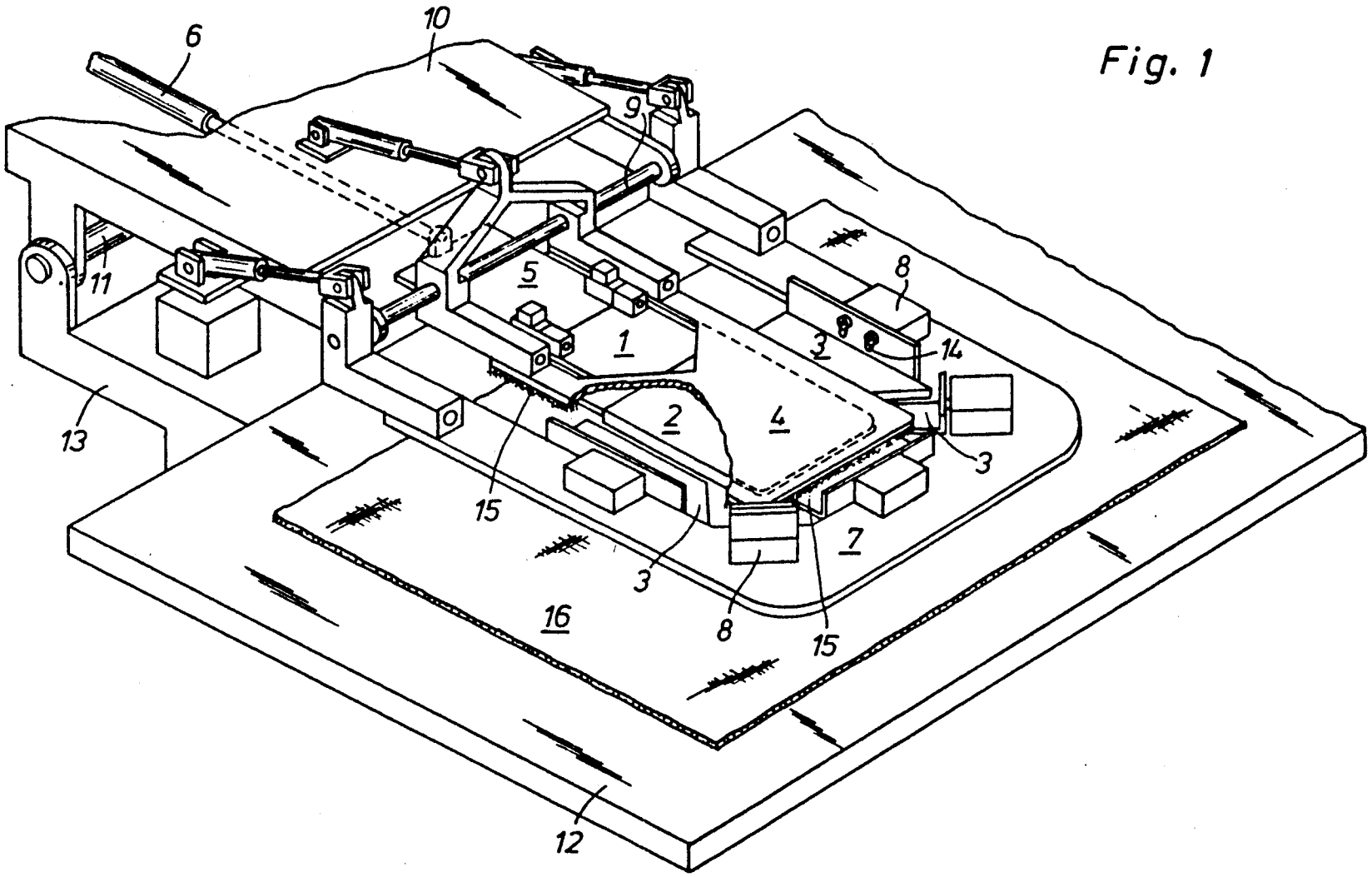
FIG. 1 is a schematic perspective view of one embodiment of the solution according to the present invention.

The embodiment of a device according to the present invention, which is shown in FIG. 1, has a fabric support plate 1 for a fabric 2 to be bent, beneath which bending plates 3 are arranged in a plane that is essentially parallel to the fabric support plate and is located at a variable distance from it, and a pressing plate 4 above the fabric support plate 1.

The fabric support plate 1 is connected to a pneumatic cylinder 6 via a bracket 5 and can be displaced by this pneumatic cylinder 6 in the plane in which it is arranged. The bending plates 3 are connected to pneumatic cylinders 8 arranged on a support frame 7. The bending plates 3 can be displaced to below the fabric support plate 1 in the plane in which they are arranged. Both the support frame 7 and the pressing plate 4 are arranged pivotably around a shaft 9, which is mounted in a holding part 10. The holding part 10 in turn is arranged pivotably on a shaft 11, which is mounted on a support part 13 that is rigidly connected to a support plate 12 for a fabric layer. The bending plates 3 and the pressing plate 4 are thus pivotable around the shaft 9 in relation to the fabric support plate 1 and around the shaft 11 in relation to the support plate 12.

The folding plates 3 are bend off at their end facing the respective pneumatic cylinder 8 and are provided with slotted holes 14 on the bent part for height adjustment.

According to the present invention, the pressing plate 4 is larger than the fabric support plate 1, so that this extends beyond the outer contours of the fabric support plate 1. In the arrangement according to the embodiment (FIG. 1 and FIG. 2), the pressing plate 4 has a VELCRO type strip (particularly a hook strip) acting as an elastically deformable holding means 15 along its edge zone on the side facing the fabric support plate 1. The VELCRO type strip 15 is arranged such that it extends at right angles to its longitudinal extension on both sides of the outer contour of the fabric support plate 1 facing it, i.e., part of it extends between the pressure plate 4 and the fabric support plate 1, and another part of it extends next to the fabric support plate 1.

Figure 2A:
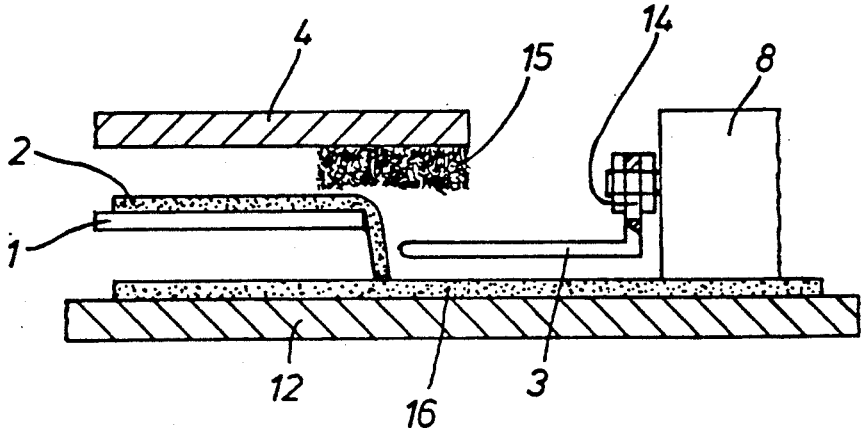
FIGS. 2*a*-2*c* are cross sectional views showing the coordination of the plates—the fabric support plate and the bending plates—at a bending edge in various phases.

A fabric layer 2, e.g., a pocket, which is to be bent over and is subsequently to be sewn to the fabric 16 that is placed on the support plate 12, is positioned on the fabric support plate 1, after the distance between the planes of movement of the two plates 1 and 3 ha been adjusted, especially to the thickness of the fabric 2 to be bent over (FIG. 2*a*). The pressing plate 4 is subsequently placed on the fabric 2, and the fabric is fixed. Fixation is performed by means of the VELCRO type strip (15) arranged in the edge zone of the pressing plate 4 in such a way that the area of the VELCRO type strip located between the pressing plate 4 and the fabric 2 lying on the fabric support plate 1 will be compressed, and the hooks will firmly hold the fabric, and the area of the VELCRO type strip located next to the fabric support plate 1 presses the projecting edge of the fabric 2 around the outer contour of the fabric support plate 1, and supports it in this bent position (FIGS. 2*b* and 2*c*), i.e., it acts as a guide surface or abutment in the bending area of the fabric 2.

Figure 2B:
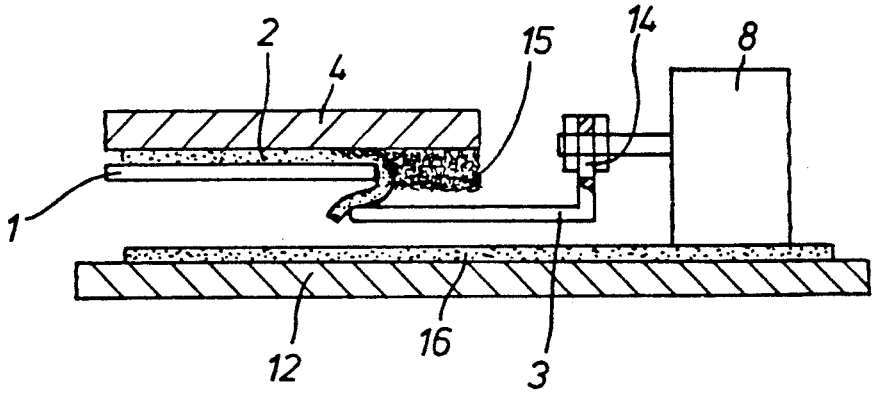
Figure 2C:
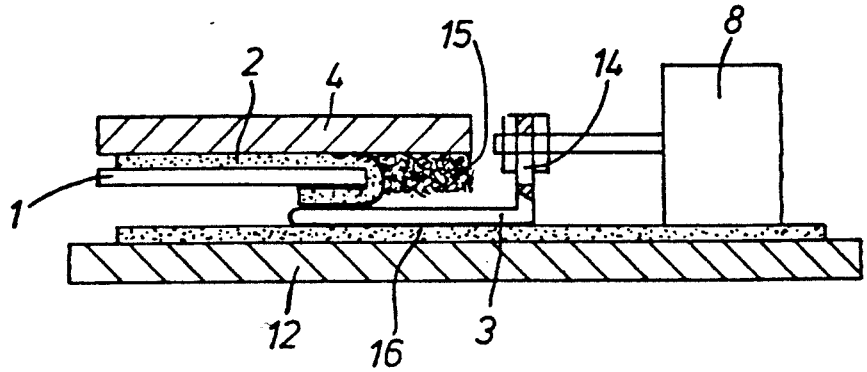

The bending plates 3 are subsequently pushed under the fabric support plate 1, and the bend edges of the fabric 2 are bent over nearly completely and placed on the underside of the fabric support plate 1 (FIG. 2*b*). The pressing plate 4, the fabric support plate 1, and the bending plates 3 are subsequently lowered onto the fabric part 16 (FIG. 2*c*), and the bending plates 3 are again retracted and raised along with the pressing plate 4. The bent-over edge of the fabric 2 remains intact on withdrawal of the bending plates 3. Consequently, no clamping device for exerting a clamping force to hold the bent-over edges of the fabric 2 is necessary.

A feed plate of known design (not shown), which is provided with a needle guide opening in the area of the seam formed, is subsequently placed on the fabric 2 in the known manner, the fabric support plate 1 carrying the fabric is pressed against the fabric layer 16 by the feed plate, the fabric support plate 1 is extracted from the bent-over fabric 2, and the fabric layer 16, provided with the fabric 2, is displaced on the support plate 12 to the sewing station by the feed plate.

While a specific embodiment of the invention has been shown and described in detail to illustrate the application of the principles of the invention, it will be understood that the invention may be embodied otherwise without departing from such principles.

What is claimed is:

1. A device for binding over a fabric, comprising: a fabric support plate with edges defining bending edges; pressing means movable to be placed on the fabric, the outer contour of the pressing means extending beyond an outer contour of the fabric support plate, said pressing means having at least in an edge zone an elastically deformable holding means for the fabric, forming a guide surface for a bending area of the fabric after the pressing means has been placed over the fabric; and a bending plate cooperating with said fabric support plate and movable beneath and in parallel to a plane of said fabric support plate.

2. A device according to claim 1, wherein said holding means is arranged on a side of said pressing member facing said fabric support plate along its edge zone, extending on opposite sides of said outer contour of said fabric support plate facing said holding means.

3. A device according to claim 2, wherein said holding means is a VELCRO type fastening strip.

4. A device according to claim 3, wherein said VELCRO type fastening strip is a hook type fastening element.

5. A device for binding over a fabric, comprising: a fabric support plate with at least one edge defining a bending edge; pressing means for pressing a fabric for binding over, said pressing means including a pressing member that can be pressed toward a fabric on said fabric support plate, said pressing member having an outer contour extending beyond said bending edge of said fabric support plate; an elastically deformable holding means provided on an edge zone of said pressing means, said elastically deformable holding means extending over said bending edge of said fabric support plate to said outer contour of said pressing member to define a guide surface for a bending area of the fabric as said pressing member is moved toward said fabric; and a bending plate cooperating with said fabric support plate and moveable beneath and in parallel to a plane of said fabric support plate.

* * * * *